US005394588A

United States Patent [19]

Kweon et al.

[11] Patent Number: 5,394,588

[45] Date of Patent: Mar. 7, 1995

[54] NOZZLE HEAD FOR VACUUM CLEANER WITH DUSTER FUNCTION

[75] Inventors: Hyeog M. Kweon; Young G. Min; Im M. Kim, all of Kyungsangnam-Do, Rep. of Korea

[73] Assignee: Goldstar Co., Ltd., Seoul, Rep. of Korea

[21] Appl. No.: 52,567

[22] Filed: Apr. 23, 1993

[30] Foreign Application Priority Data

Apr. 23, 1992 [KR] Rep. of Korea ..... 6744/1992
May 20, 1992 [KR] Rep. of Korea ..... 8720/1992
May 29, 1992 [KR] Rep. of Korea ..... 9317/1992

[51] Int. Cl.[6] ..... A47L 9/06

[52] U.S. Cl. ..... 15/372; 15/392; 15/389

[58] Field of Search ..... 15/48.1, 371, 372, 389, 15/390, 392

[56] References Cited

U.S. PATENT DOCUMENTS

| | | | |
|---|---|---|---|
| 1,624,251 | 4/1927 | Keefer | 15/392 |
| 1,713,184 | 5/1929 | Lang | 15/389 |
| 1,903,794 | 4/1933 | Richardson | 15/392 |
| 2,317,000 | 4/1943 | Eisenlohr | 15/390 |
| 3,802,026 | 4/1974 | Crener | 15/392 |
| 3,892,003 | 7/1975 | Peabody | 15/392 |
| 3,913,168 | 10/1975 | Lovgren | 15/371 |
| 4,091,496 | 5/1978 | Desrosters | 15/371 |
| 4,817,233 | 4/1989 | Waldhauser | 15/320 |
| 4,976,003 | 12/1990 | Williams | 15/392 |
| 5,077,862 | 1/1992 | Rench | 15/320 |

FOREIGN PATENT DOCUMENTS

| | | | |
|---|---|---|---|
| 391980 | 9/1965 | Switzerland | 15/371 |
| 9210967 | 7/1992 | WIPO . | |

*Primary Examiner*—David A. Scherbel
*Assistant Examiner*—Terrence R. Till
*Attorney, Agent, or Firm*—Ostrolenk, Faber, Gerb & Soffen

[57] ABSTRACT

A nozzle head for a vacuum cleaner employing a roller-shaped duster that can be rotated and removed in order to improve efficiency of duster-cleaning. The nozzle head comprises outer and inner casings spaced from each other, a duster supporting shaft detachably and rotatably mounted in the inner casing, a roller-shaped duster member inserted on the duster supporting shaft, a duster holding member which has means for holding the duster supporting shaft and is slidably mounted in the inner casing, means for locking the duster holding member which is fixed to the inner casing, and means for stopping the duster supporting shaft which is disposed between the duster holding member and the opposite ends of the duster supporting shaft.

14 Claims, 11 Drawing Sheets

NOZZLE HEAD FOR VACUUM CLEANER WITH DUSTER FUNCTION

BACKGROUND OF THE INVENTION

1. Field of the Invention

The present invention is related to a nozzle head for a vacuum cleaner with a duster function, and more particularly to a nozzle head for a vacuum cleaner with a duster function which employs a roller-shaped duster member that is rotated at a predetermined angle in accordance with the moving direction of the nozzle head when required in order to use a larger cleaning surface of the duster member, thereby improving cleaning efficiency of the duster member, and which causes attachment and detachment of the duster member to be easy and separation of the duster member to be prevented during use, thereby providing the user with considerable convenience.

2. Description of the Prior Art

Referring to FIGS. 1 and 2, there is shown a conventional nozzle head for a vacuum cleaner. As shown in the drawings, the nozzle head comprises upper and lower casings 1 and 2, a ]-shaped frame 4 for fixing a flat duster 3 therein which is received in the upper and lower casings 1 and 2, a support plate 5 for pressing the duster 3 which is inserted in the frame 4 and mounted on the upper casing 1 by means of a screw 6, a pair of compression coil springs 7 and 7' interposed between the upper casing 1 and the frame 4, and a compression coil spring 7'' disposed between the upper casing 1 and the support plate 5.

Note specifically stated, the upper casing 1 is formed with a pair of locking holes 8 at opposite ends. The locking holes 8 and 8' are provided at inner surfaces thereof With shoulders 9 and 9', respectively (see FIG. 2). The lower casing 2 is formed with an elongated rectangular hole 10 at its central portion. An air-introducing path 17 is defined by rear parts of the upper and lower casing 1 and 2.

The frame 4 is provided at its opposite ends with elastic hooks 11 and 11' projecting upward, which are to be engaged with the shoulders 9 and 9' of the upper casing 1, respectively. The frame 4 is also provided with a pair of guide rods 12 and 12' having predetermined length and projecting upward at its upper surface and between the hooks 11 and 11'. The guide rods 12 and 12' are inserted in the compression coil springs 7 and 7'. The upper plate of the frame 4 is formed with a semicircular recess 13 at a middle portion of its front end. The frame 4 has a lower plate 14 for sustaining the duster 3.

The support plate 5 is provided with a central boss 15, which is inserted in the semicircular recess 13. The central boss 15 is formed with a screw hole 16 at its upper end so that the support plate 5 is mounted on the lower surface of the upper casing 1 by means of the screw 6. Also, the central boss 15 is inserted in the compression coil spring 7''.

In use of the above-constructed nozzle head for a vacuum cleaner, the frame 4 which is assembled with the support plate 5 is moved downward and then the support plate 5 is mounted on the upper casing 1 in such a manner that the screw 6 is engaged with the upper casing 1 through the screw hole 16 of the central boss 15. Subsequently, the duster 3 is put lo between the support plate 5 and the lower plate 14 of the frame 4 and the frame 4 is pushed upward. At this time, since the compression coil spring 7'' is compressed, the support plate 5 is moved downward due to the compressive force of the coil spring 7'' so that the duster 3 is firmly fixed between the support plate 5 and the lower plate 14.

Thereafter, as the frame 4 is further pushed upward, the compression coil springs 7 and 7' are compressed and the elastic hooks 11 and 11' of the frame 4 are engaged with the corresponding shoulders 9 and 9' of the upper casing 1, as illustrated in FIG. 2, so that the duster 3 is more firmly fixed between the support plate 5 and the lower plate 14.

On the other hand, when it is necessary to separate the duster 3 from the nozzle head, the elastic hooks 11 and 11' of the frame 4 are pushed inward or toward each other to disengage the hooks 11 and 11' from the shoulders 9 and 9'. Then, since the locked condition of the frame 4 and the support plate 5 is released because of the restoring force of the compression coil springs 7, 7' and 7'', the duster 3 can be separated from the nozzle head.

However, the above-mentioned conventional nozzle head for a vacuum cleaner has disadvantages as follows:

Since the conventional nozzle head for a vacuum cleaner employs a flat duster, a contact surface of the duster which is in contact with a floor is limited in its lower surface so that the duster is easily contaminated, thereby decreasing cleaning efficiency.

Also, when the duster is changed with a fresh duster, the frame and the support plate must be fully disassembled from the nozzle head and assembled.

Furthermore, since what actually supports the duster is the central compression coil spring inserted in the boss of the support plate, when the elasticity of the compression coil spring is deteriorated by use over a long period of time, the duster may be accidentally separated from the nozzle head because the duster can not overcome a frictional force with a floor.

SUMMARY OF THE INVENTION

The present invention has been made in view of the above-described problems occurring in the prior art and an object of the invention is to provide a nozzle head for a vacuum cleaner with a duster function which employs a roller-shaped duster member that can be rotated through a predetermined rotational angle in accordance with the moving direction of the nozzle head so that it is possible to use a larger cleaning surface of the duster member, thereby improving cleaning efficiency of the duster member.

Another object of the invention is to provide a nozzle head for a vacuum cleaner with a duster function which causes attachment and detachment of the duster member to be easy and separation of the duster member to be prevented during use, thereby providing the user with considerable convenience.

In accordance with the present invention, the objects mentioned above can be accomplished by providing a nozzle head for a vacuum cleaner with a duster function comprising: outer and inner casings which define front and rear air introducing paths therebetween; a duster supporting shaft detachably and rotatably mounted in the inner casing; a roller-shaped duster member inserted on the duster supporting shaft; a duster holding member which has means for holding releasably the duster supporting shaft and is upward and downward slidably mounted in the inner casing; means for locking the duster holding member which is fixedly mounted on an inner surface of the inner casing; and means for stopping selectively the duster supporting shaft which is disposed between the duster holding member and the opposite ends of the duster supporting shaft.

The means for stopping the duster supporting shaft comprises a cam-stopping groove formed at an end of the duster supporting shaft and a cam follower fixed to the duster holding member and inserted in the cam-stopping groove which is adapted to rotate or stop selectively the duster supporting shaft in accordance with a rotating direction of the duster supporting shaft.

In accordance with another aspect of the invention, the means for stopping the duster supporting shaft may comprise at least one of ratchet tooth formed at an outer surface of an end of the duster supporting shaft and a pawl piece fixed to the duster holding member and engaged with the ratchet tooth to stop the duster supporting shaft when the duster supporting shaft is rotated in a normal direction.

In accordance with still another aspect of the invention, the means for stopping the duster supporting shaft may comprise: a smaller diameter shaft provided at an end of the duster supporting shaft which is formed at its outer end with a circular recess and formed with at least one of an axial guide cut portion; a cam supporting plate having a shaft part which is formed at its outer surface with a serrated, cam-stopping groove, inserted in the circular recess of the duster supporting shaft and rotatably inserted on a supporting pin fixed to a center of an end of the duster supporting shaft; a cam follower mounted on the smaller shaft which is inserted in the cam-stopping groove through the axial guide cut portion at its free end; and a compression spring adapted to bias the cam follower inward.

The duster supporting shaft may have a rectangular section or a circular section. The circular shaft may be formed with a plurality of axial recesses in order to increase friction force between the shaft and the duster member.

In operation of the nozzle head for a vacuum cleaner of the invention, when the nozzle head is pushed frontward, the duster assembly is immediately stopped or slightly rotated and then stopped so that the duster assembly can clean a floor in its stopped condition. Thereafter, when the nozzle head is pulled rearward, the duster assembly is rotated or slightly rotated and then stopped so that a cleaning surface of the duster member is changed with another surface. In this case, dirt such as dust is sucked into the front and rear air introducing paths and then collected in a dust collecting chamber of a canister body.

BRIEF DESCRIPTION OF THE DRAWINGS

These and other objects, features and advantages of the invention will become more apparent upon a reading of the following detailed specification and drawings, in which.

DETAILED DESCRIPTION OF THE PREFERRED EMBODIMENTS

Figure 1:
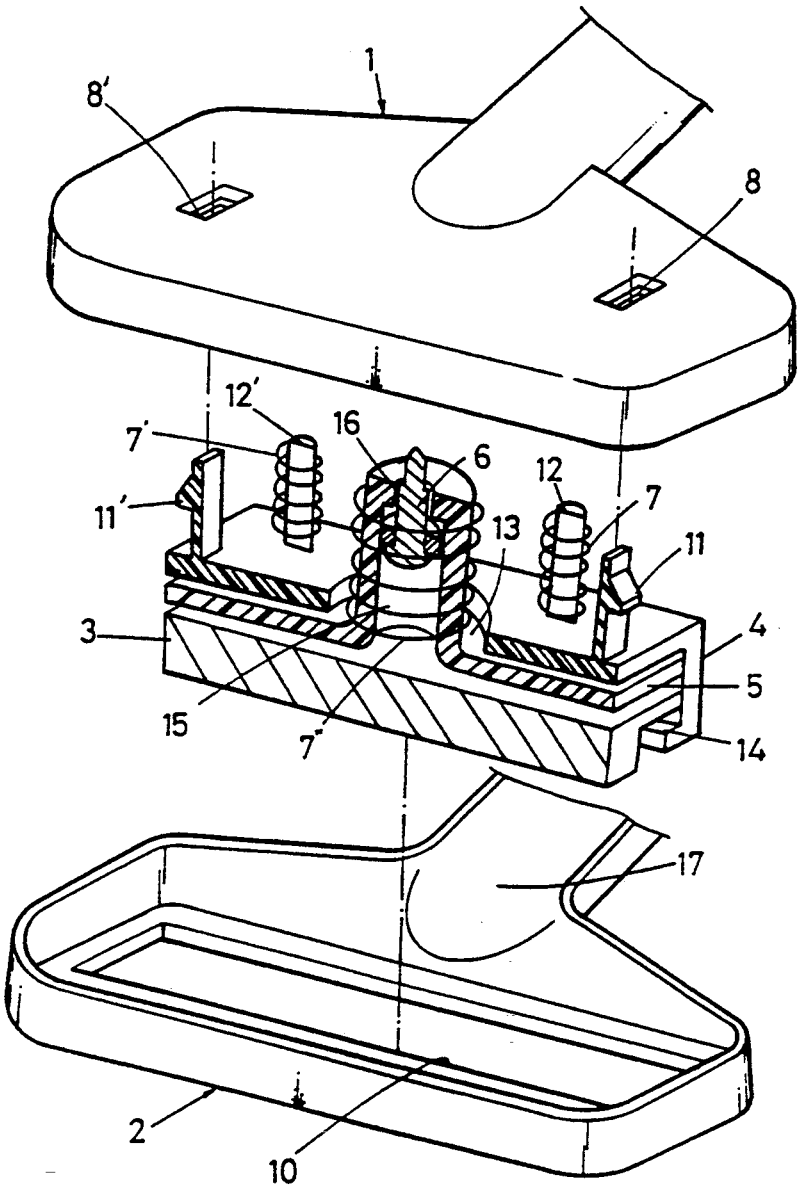
FIG. 1 PRIOR ART
FIG. 1 is an exploded perspective view of a conventional nozzle head for a vacuum cleaner.
Figure 2:
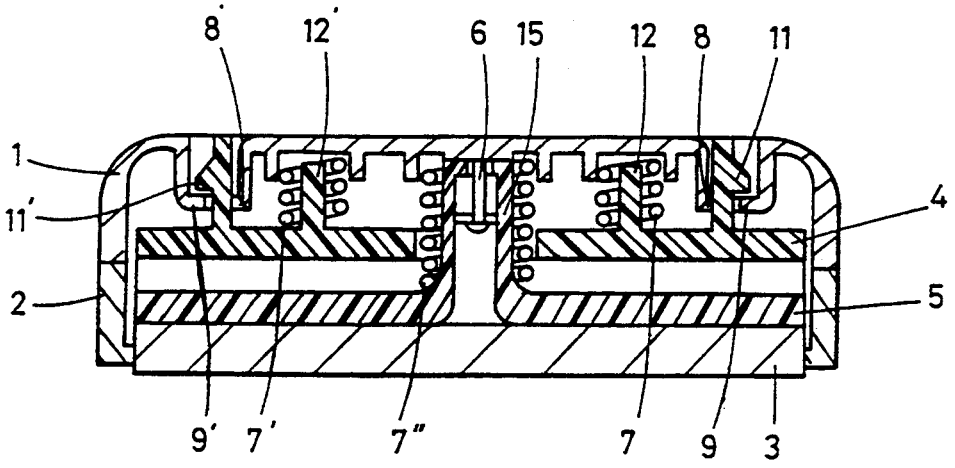
FIG. 2 PRIOR ART
FIG. 2 is a sectional view of FIG. 1 in which a duster member is fixed.

A nozzle head for a vacuum cleaner with a duster function according to the present invention will now be described in detail by referring to accompanying drawings.

Referring to FIGS. 3 to 7, there is shown a nozzle head for a vacuum cleaner of the invention. As shown in the drawings, the nozzle head for a vacuum cleaner "A" of the invention comprises outer and inner casings 23 and 24 which define front and rear air introducing paths 25 and 26 therebetween, a duster supporting shaft 21 detachably and rotatably mounted in the inner casing 24, a roller-shaped duster member 22 inserted on the duster supporting shaft 21, a duster holding member 40 which has means for holding releasably the duster supporting shaft 21 and is upward and downward slidably mounted in the inner casing 24, means for locking the duster holding member 40 which is fixedly mounted on an inner surface of the inner casing 24, and means for stopping selectively the duster supporting shaft 21 which is disposed between the duster holding member 40 and the both ends of the duster supporting shaft 21.

More in detail, the duster supporting shaft 21 having a rectangular shape and the roller-shaped duster member 22 inserted on the duster supporting shaft 21 constitute a duster assembly 20.

The nozzle head "A" comprises the outer casing 23 and the inner casing 24 provided in the outer casing 23 with the front and rear air introducing paths 25 and 26 therebetween. The front and rear air introducing paths 25 and 26 are in communication with each other at its upper position. Also, the air introducing paths 25 and 26 are in communication with an air introducing path 75 of a wand (see FIGS. 5A and 5B). The inner casing 24 has a reception groove 27 for receiving the duster holding member 40 therein.

Figure 3:
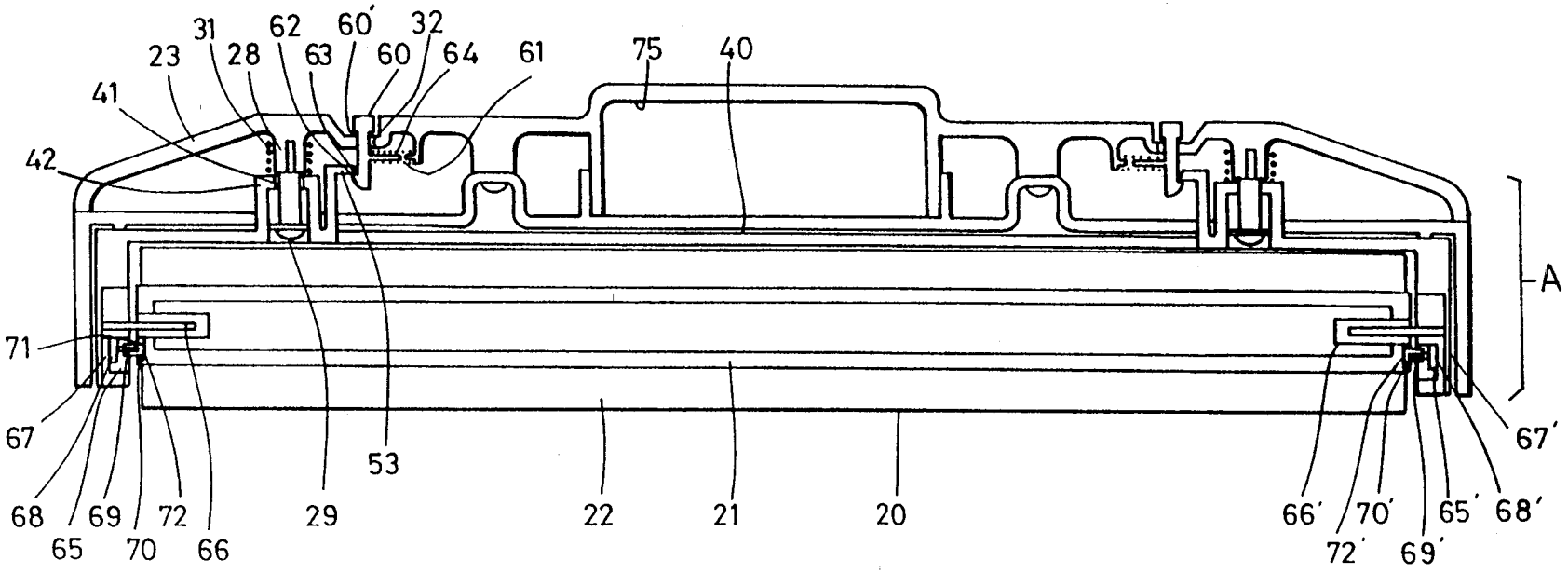
FIG. 3 is a sectional view of a nozzle head for a vacuum cleaner according to the present invention which employs a roller-shaped duster member and means for stopping duster supporting shaft according to an embodiment of the invention.
Figure 4:
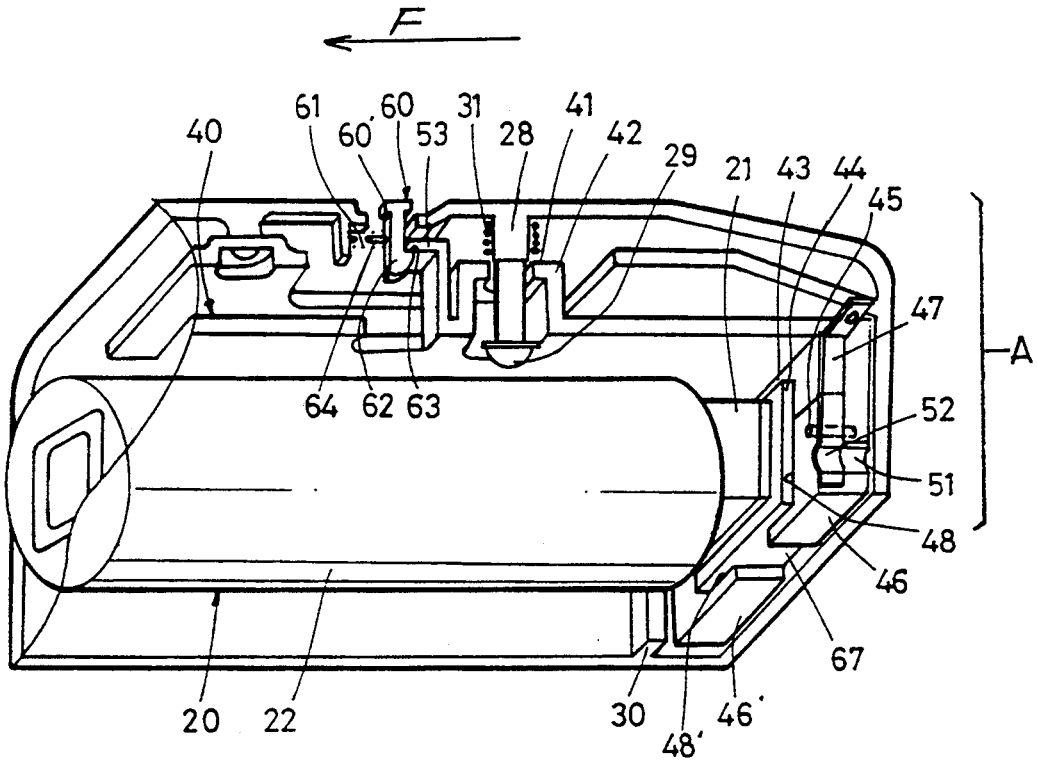
FIG. 4 is a perspective of a reversed nozzle head according to the embodiment of the invention in which a roller-shaped duster assembly is held.

The outer casing 23 is provided with a pair of suspending bosses 28 at both sides of its upper portion (a lower portion in FIGS. 3 and 4). The duster holding member 40 has a pair of projections 42 at positions corresponding to the positions of the suspending bosses 28. Each of the projections 42 is formed with a boss hole 41 at its top. A screw is engaged with each of the suspending bosses 28 of the duster holding member 40 through the boss hole 41 of the projection 42 so that the duster holding member 40 is moved upward and downward along the screw 29 and the suspending boss 28. The inner casing 24 is provided with guide rails 30 at positions spaced from both side walls to form guide grooves therebetween so that the duster holding member 40 is slidably inserted in the grooves at opposite ends.

Also, a compression spring 31 inserted on each of the suspending bosses 28 of the outer casing 23 and interposed between the outer casing 23 and the projection 42 of the duster holding member 40 to bias the duster holding member 40 downward.

The means for holding duster comprises two pairs of pivot arms 46 and 46′ which are pivotally mounted on opposite side walls 43 of the duster holding member 40 about hinge pins 45 and 45′ to hold the duster supporting shaft 21 of the duster assembly 20 and leaf springs 47 and 47′ each of which is fixed to the inner casing 24 at its upper end and engaged with the pivot arm 46 or 46′ at its lower end to pivot outward the pivot arm 46 or 46′ during a downward movement of the duster holding member 40.

The pivot arms 46 and 46′ have inward extended jaws 48 and 48′ at lower ends thereof respectively and the side walls 43 are formed with semirectangular recesses 44 respectively. Therefore, when the pivot arms 46 and 46′ are fully inward pivoted, each pair of the pivot arms define a rectangular space 49 together with the semirectangular recess 44 for receiving the duster supporting shaft 21. On the other hand, when the duster holding member 40 is moved downward so that the pivot arms are pivoted outwardly, the duster assembly 20 can be removed from the pivot arms 46 and 46′ through entrances 50.

Figure 5A:
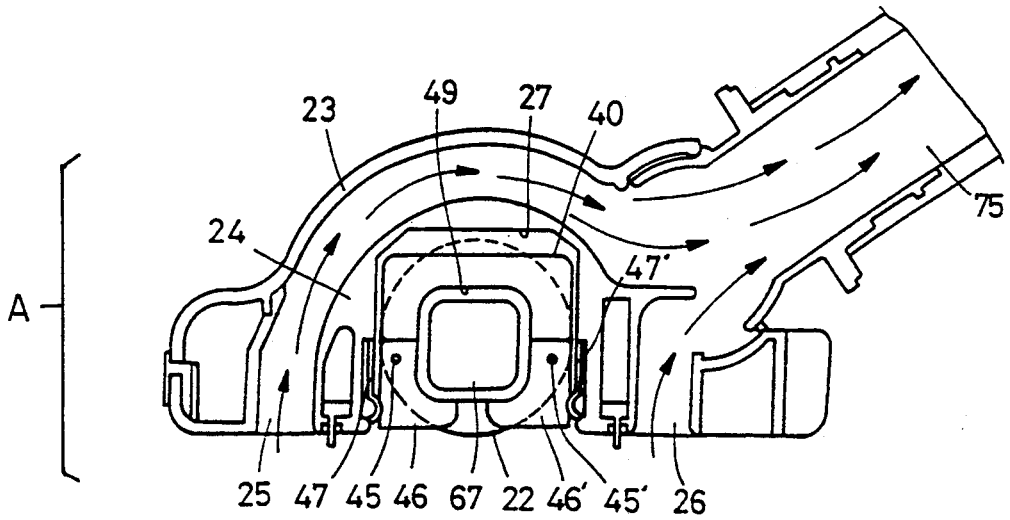
FIG. 5A is a sectional view of a nozzle head having the means for stopping duster supporting shaft according to the embodiment of the invention when the roller-shaped duster assembly is held therein.
Figure 5B:
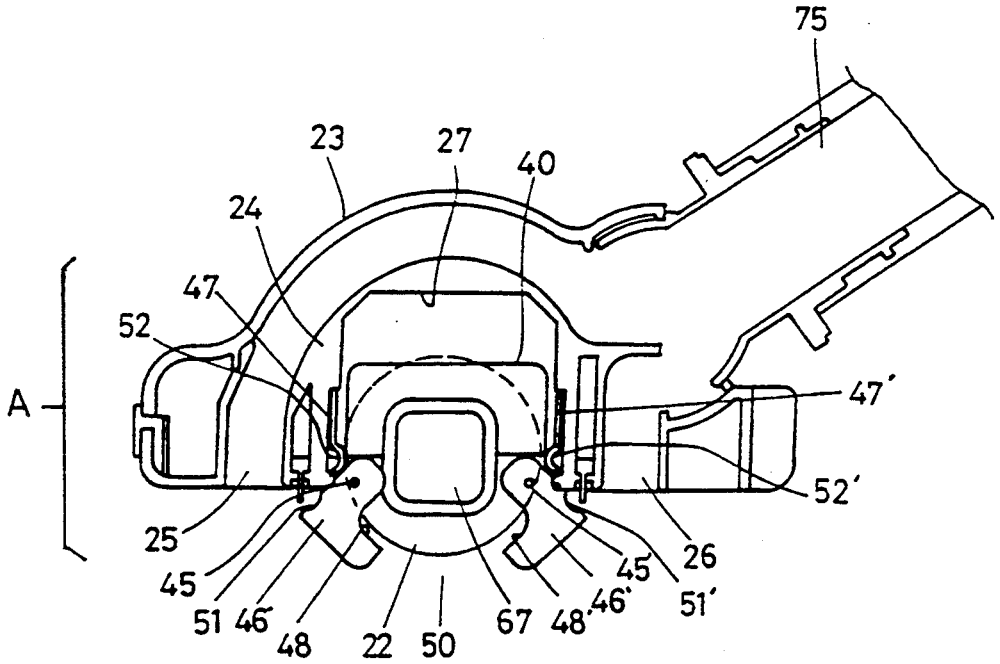
FIG. 5B is a sectional view of a reversed nozzle head of FIG. 5A when the roller-shaped duster assembly is to be removed.

The pivot arms 46 and 46′ are formed at outer surfaces thereof with engaging grooves 51 and 51′ respectively and the leaf springs 47 and 47′ are curled inward at lower ends thereof to form projections 52 and 52′ respectively. Consequently, when the duster assembly 20 is fully held in the pivot arms 46 and 46′, as shown in FIG. 5A, the projections 52 and 52′ of the leaf springs 47 and 47′ are engaged with the engaging grooves 51 and 51′ of the pivot arms 46 and 46′ respectively. On the other hand, when the duster holding member 40 is moved downward, the projections 52 and 52′ of the leaf springs 47 and 47′ push inward the upper ends of pivot arms 46 and 46′ respectively to pivot outward the lower section of the pivot arms 46 and 46′, as shown in FIG. 5B.

The means for locking and unlocking the duster holding member comprises a pair of locking projections 53 (FIGS. 3 and 4) provided at guide holes 54 of the upper wall of the duster holding member 40, a pair of lockers 60 each of which is inserted into a guide hole 32 (FIG. 3) of the outer casing 23 and the guide hole 54 and engaged with the locking projection 53, and compression springs 61 for elastically biasing the lockers 60 toward the locking projections 53.

The lockers 60 each has an upper head 60′ for preventing the locker 60 from dropping into the guide hole 32 of the outer casing 23. Also, the locker 60 has formed at its lower end a slant 62 for facilitating the engagement with the duster holding member 40 and formed at an upper end of the slant with a locking hook 63 adapted to be engaged with the locking projection 53 of the duster holding member 40. The locker is also provided with a spring-guiding protrusion 64 at its side opposite to the locking hook 63. The spring-guiding protrusion 64 of the locker 60 is inserted in the compression spring 61 in order to bias the locker 60 toward the locking projection 53.

Figure 6:
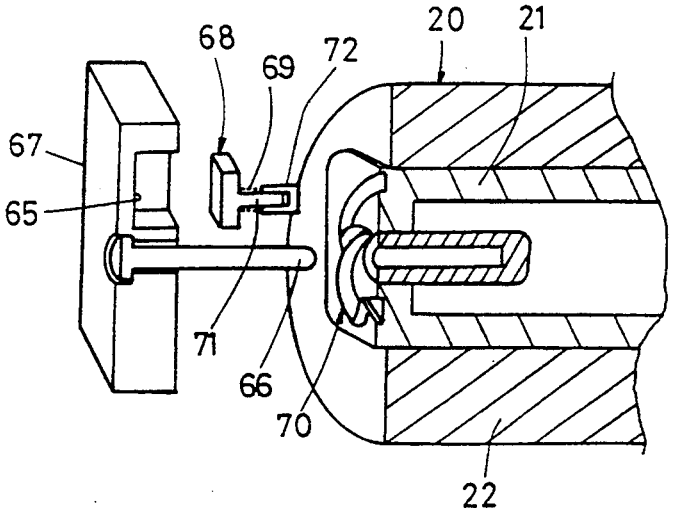
FIG. 6 is an exploded perspective view of the means for stopping duster supporting shaft according to the embodiment of the invention.

As shown in FIG. 6, the means for stopping the duster supporting shaft comprises rectangular cam supporting plates 67 and 67′ rotatably mounted on the opposite ends of the duster supporting shaft 21 by supporting pins 66 and 66′ each of which has a guide groove 65 or 65′, cam followers 68 and 68′ disposed in the guide grooves 65 and 65′ of the cam supporting plates 67 and 67′ which is movable upward and downward in the guide grooves 65 and 65′, and cam stopping grooves 70 formed at the opposite ends of the duster supporting shaft 21 for guiding the cam followers 68 and 68′ respectively.

The cam followers 68 and 68′ each has an inward extended protrusion 71 or 71′. The projections 71 and 71′ are slidably inserted in caps 72 and 72′ respectively and compression coil springs 69 and 69′ are disposed between the cam followers 68 and 68′ and the caps 72 and 72′ respectively to bias the cam stopping grooves 70 and 70′. It is preferable that the compression springs 69 and 69′ are fixed to the cam followers 68 and 68′ and the caps 72 and 72′ at opposite ends thereof.

Figure 7A:
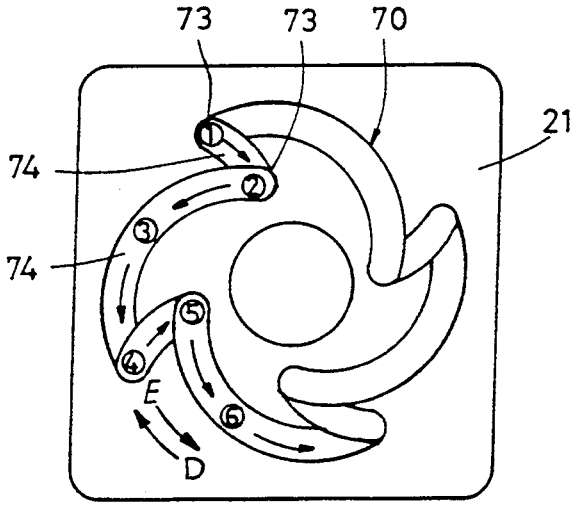
FIG. 7A is a side view of the duster supporting shaft having a cam stopping groove of the means which shows an operation of the means according to the embodiment of the invention.
Figure 7B:
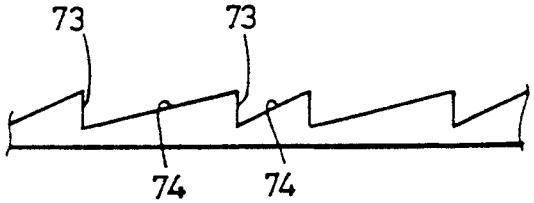
FIG. 7B is a sectional view of the cam stopping groove of FIG. 7A which is spread.

Referring to FIGS. 7A and 7B, there are shown the cam stopping grooves. As shown in the drawings, the cam stopping grooves 70 and 70′ each is formed at its bottom surface with a plurality of step portions 73 for preventing normal rotation of the duster supporting shaft 21 and the plurality of inclined surfaces 74 alternatingly. Accordingly, the cam stopping grooves 70 and 70′ each has an endless propeller shape when viewed from front and a serration shape when viewed from a section.

The operation of the above-mentioned nozzle head for a vacuum cleaner with a duster function according to the present invention will be described as follows.

FIGS. 4 and 5A show the nozzle held "A" which is mounted with the duster assembly 20 in a condition of duster-cleaning. In this condition, since the lockers 60 in the outer casing 23 are engaged with the duster holding member 40, the duster holding member 40 is received in the reception groove 27.

At this time, the compression springs 31 are compressed to bias the duster holding member 40 downward and the projections 52 and 52′ of the leaf springs 47 and 47′ fixed to the inner casing 24 are engaged with the engaging grooves 51 and 51′ of the pivot arms 46 and 46′. Therefore, the cam supporting plates 67 and 67′ rotatably mounted on the duster supporting shaft 21 of the duster assembly 20 are received in the rectangular spaces 49 defined by the jaws 48 and 48′ of the pivot arms 46 and 46′ and the semi rectangular recesses 44 formed at the duster holding member 40 so that the cam supporting plates 67 and 67' can not be separated from the duster holding member 40.

When the nozzle head "A" retaining the duster assembly 20 is used to clean a floor, the nozzle head "A" is pushed frontward by the user. At this time, since the duster supporting shaft 21 is rotated in the direction of an arrow "D", as shown in FIG. 7A, the caps 72 and 72' of the cam followers 68 and 68' are caught on the step portions 73 of the cam stopping grooves 70 and 70', for example on a portion (1) in FIG. 7A, by a restoring force of the compression coil springs 69 and 69'. Therefore, since the duster assembly 20 is moved frontward in the stopped condition, the stopped duster 20 can wipe efficiently the floor. At this time, dirt such as dust is sucked into a dirt collecting chamber in a canister body through the front and rear air introducing paths 25 and 26.

On the other hand, when the nozzle head "A" is pulled rearward, the duster supporting shaft 21 is rotated in a direction of an arrow "E" in FIG. 7A. Consequently, the caps 72 and 72' of the cam followers 68 and 68' are pushed outward against the compression coil springs 69 and 69' and guided from the portions (1) to the portions (2) in FIG. 7A, that is, guided from the lower positions to the higher positions of the inclined surfaces 74. Then, as the duster supporting shaft 21 is further rotated in the direction, the caps 72 and 72' are escaped from the inclined surfaces 74 so that the caps 72 and 72' are disposed at a lower portions of the next inclined surfaces 74 due to the restoring force of the compression coil springs 69 and 69'.

When the nozzle head "A" is again pushed frontward after the duster supporting shaft 21 is rotated at a predetermined angle, as mentioned above, the caps 72 and 72' of the cam followers 68 and 68' are caught on the step portions 73 at the portions (2). Accordingly, the duster assembly 20 can wipe the floor with its fresh contacting surface while it is moved frontward in stopped condition.

As described above, as the nozzle head "A" is repeatedly moved frontward and rearward, the caps 72 and 72' of the cam followers 68 and 68' are positioned at the cam stopping grooves 70 and 70' of the duster supporting shaft 21 in order of portions (1)→portions (2)→portions (3)→portions (4)→portions (4)→portions (5)→portions (6). Therefore, whenever the duster assembly 20 is rotated at a predetermined angle, the duster assembly 20 can clean the floor with its fresh contacting surface.

During the rotation of the duster supporting shaft since the cam followers 68 and 68' are guided along the propeller-shaped cam stopping grooves 70 and 70', the cam followers are raised and lowered along the guide grooves 66 and 66'.

When the duster assembly 20 is removed from the nozzle head "A" in order to change it, both lockers 60 are pushed toward each other by the user, that is, in the direction of an arrow "F" in FIG. 4. Then, since the lockers 60 are moved toward each other against the compression springs 61, the locked condition of the lockers 60 and the dustier holding member 40 is released. Consequently, the duster holding member 40 is slidably lowered along the guide rails 30 of the inner casing 24 by the restoring force of the compression coil springs 31, as shown in FIG. 3.

As the duster holding member 40 is lowered, the projections 52 and 52' of the leaf springs 47 and 47' are disengaged from the engaging grooves 51 and 51' of the pivot arms 46 and 46' and exert elasticity thereof on the outer surfaces of the pivot arms 46 and 46'. When the duster holding member 40 is completely lowered, the projections 52 and 52' of the leaf springs 47 and 47' exert elasticity thereof on the upper corners of the pivot arms 46 and 46' above the hinge pins 45. Accordingly, the pivot arms 46 and 46' are outstretched about the hinge pins 45 and 45' so that the entrance 50 having a predetermined interval is provided between each pair of pivot arms 46 and 46', thereby enabling the duster assembly 20 to be removed from the nozzle head.

When the duster assembly 20 is again mounted in the nozzle head "A", the duster supporting shaft 21 of the duster assembly 20 is inserted and disposed in the semi-rectangular recesses 44 of the duster holding member 40 and then further pushed upward against the compression springs 31 to be received in the receptions 27 of the nozzle head "A". Thereafter, since the locking hooks 63 of the lockers 60 are engaged with the duster holding member 40, the duster assembly 20 is fixedly mounted in the nozzle head "A".

As mentioned above, when the duster holding member 40 is completely mounted in the nozzle head "A", the projections 52 and 52' of the leaf springs 47 and 47' are engaged with the engaging grooves 51 and 51' of the pivot arms 46 and 46' to bias the pivot arms 46 and 46' inward.

Figure 8:
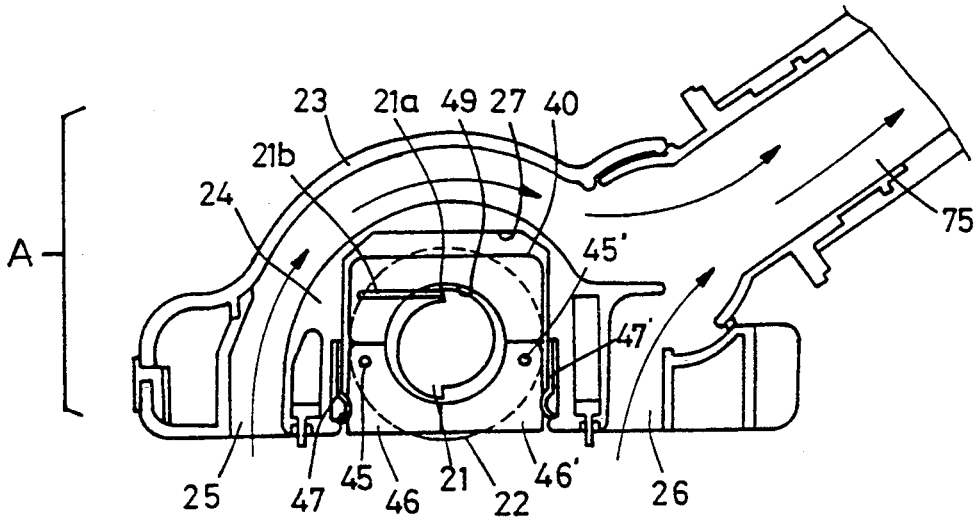
FIG. 8 is a sectional view of a nozzle head employing means for stopping duster supporting shaft according to another embodiment of the invention.

Referring to FIG. 8, there is shown another embodiment of means for stopping the duster supporting shaft according to the invention which is adapted to rotate or stop selectively the duster assembly 20 in accordance with its rotating direction. As shown in the drawing, the means for stopping duster supporting shaft comprises at least one of ratchet tooth **21*a* formed at the outer surface of the end of the duster supporting shaft 21 and a pawl 21*b* secured to the duster holding member 40 at its one end and engaged with the ratchet tooth 21*a* at its other end which is adapted to prevent normal rotation of the duster supporting shaft 21**.

In order to bias the pawl **21*b* toward the duster supporting shaft 21, it is possible to use a pawl of a resilient piece or a spring for biasing the pawl 21*b* toward the shaft 21**.

The operation of the nozzle head employing the means for stopping the duster supporting shaft according to the another embodiment of the invention will be now described.

When the nozzle head "A" is pushed frontward during cleaning, the pawl **21*b* is engaged with ratchet tooth 21*a* to stop the duster assembly 20. Accordingly, since the duster assembly 20 is moved frontward in the stopped condition, the roller-shaped duster member 22 can wipe the floor. On the other hand, when the nozzle head "A" is pulled rearward, the pawl 21*b* is disengaged from the ratchet tooth 21*a* to permit the duster assembly 20 to be rotated at a predetermined angle. Thereafter, when the nozzle head is again pushed frontward, the pawl 21*b* is engaged with other ratchet tooth 21*a* to cause the duster assembly 20 to be stopped. Hence, since the duster member 22** is moved frontward in the stopped condition, it can wipe the floor with its fresh contacting surface.

Figure 9:
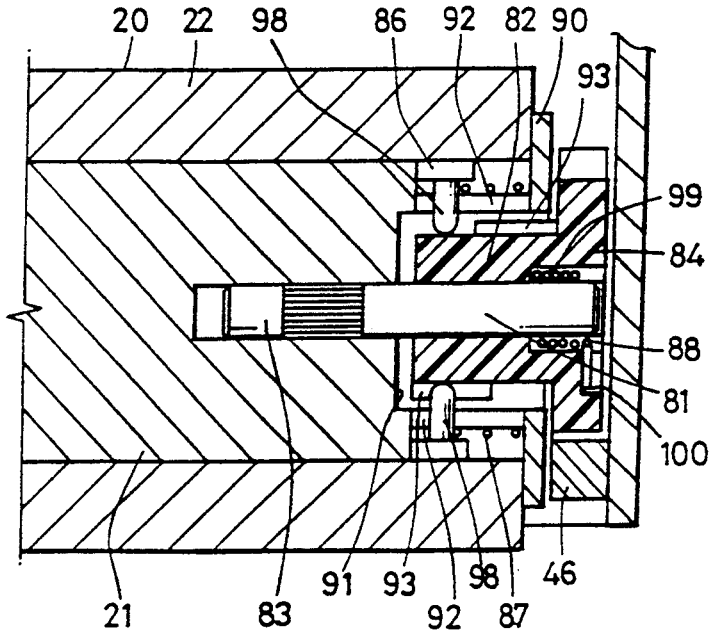
FIG. 9 is a sectional view of means for stopping duster supporting shaft according to still another embodiment of the invention.
Figure 10:
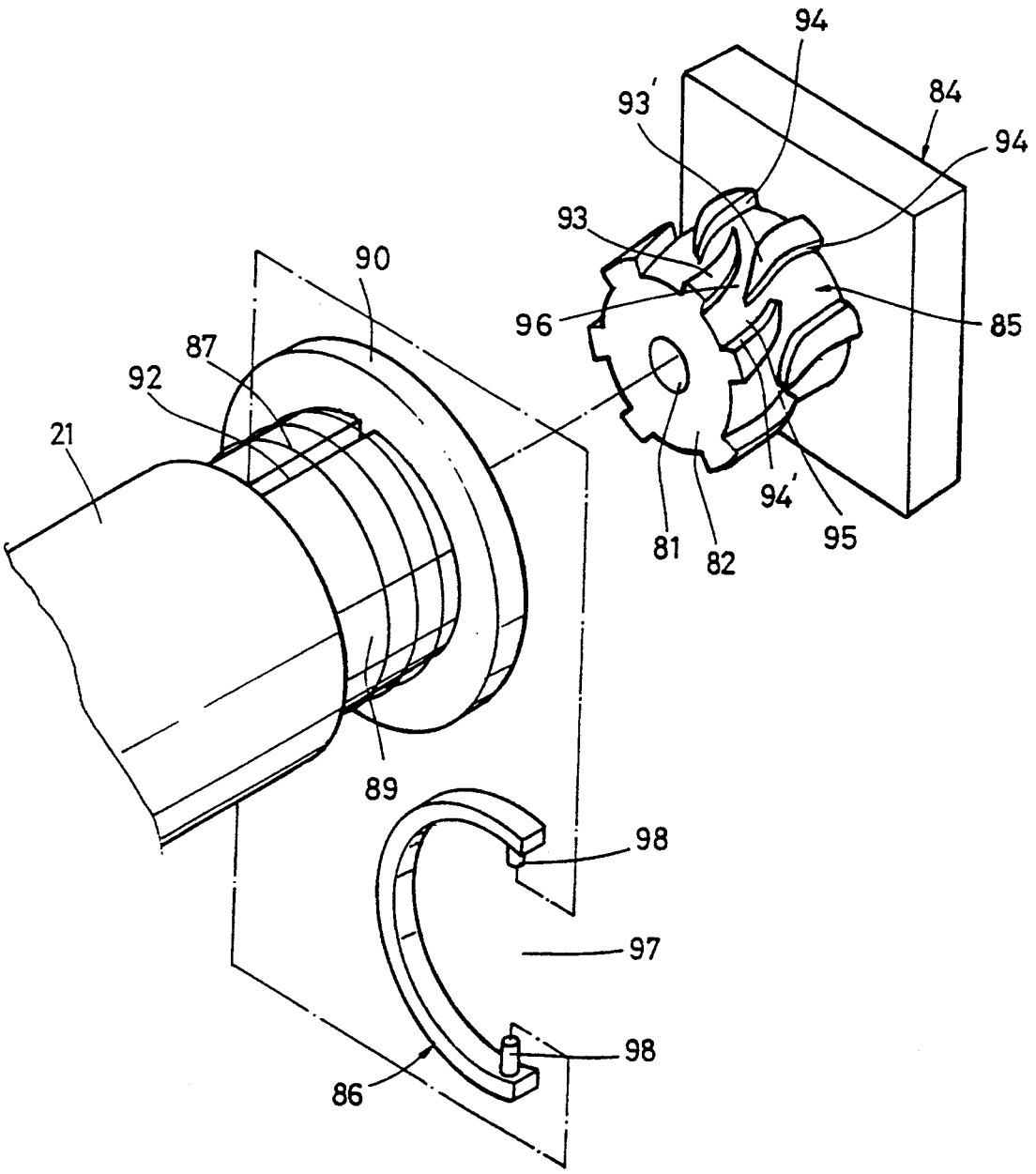
FIG. 10 is an exploded perspective view of FIG. 9.
Figure 11:
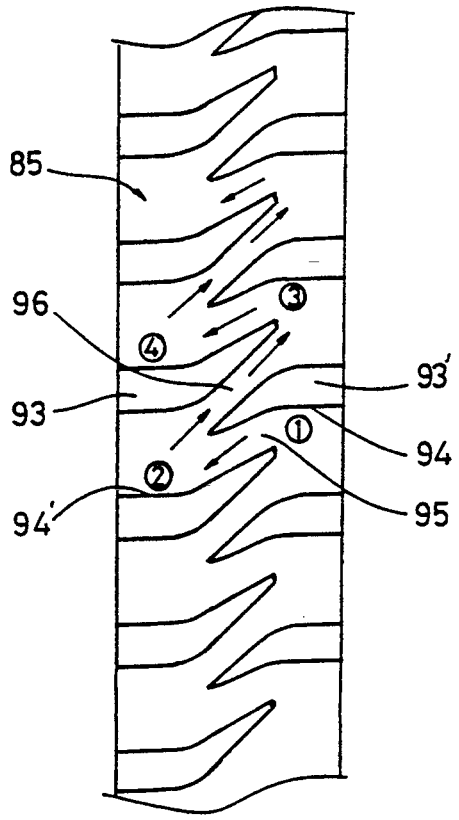
FIG. 11 is a front view of cam stopping groove of FIG. 10 which shows an operation of the means for stopping duster supporting shaft according to the still another embodiment of the invention.

Referring to FIGS. 9 to 11, there are shown still another embodiment of means for stopping the duster supporting shaft according to the invention. FIG. 9 is a sectional view of the means which is assembled, FIG. 10 an exploded perspective view of the means, and FIG.

11 an operational view of the means. As shown in the drawings, the means for stopping the duster supporting shaft comprises a pair of rectangular cam supporting plates 84 (since the right and left plates are symmetrically constructed, only one side plate is illustrated) to which shaft parts 82 having pin holes 81 are secured respectively and which are rotatably mounted on the opposite ends of the duster supporting shaft 21 by supporting pins 83, a pair of serration-shaped cam stopping grooves 85 formed at the outer surfaces of the shaft parts 82, cam followers 86 adapted to be guided along the cam stopping grooves 85, compression coil springs 87 for biasing the cam followers 86 inward, and torsional springs 88 interposed between the supporting pins 83 and the cam supporting plates 84.

The duster supporting shaft 21 is formed with smaller diameter shafts 89 at its opposite ends. The smaller diameter shafts 89 each is formed therein with a circular recess 91. A larger diameter flange 90 is secured to each of the outer ends of the small diameter portions 89 and adapted to be in contact with an end of the duster member 22. The smaller diameter shafts 89 each is formed with two axial guide cut portions 92.

The cam stopping grooves 85 each is defined by a plurality of spaced inner projections 93 and outer projections 93' formed at the outer surfaces of the shaft parts 82, as shown in FIGS. 10 and 11. The inner and outer projections 93 and 93' are positioned alternatingly and face each other in such a manner that the cam stopping groove 85 has normal rotation stopping portions 94 at the outer projections 93', rearward advancing paths 95 between the inner and outer projections 93 and 93', reverse rotation stopping portions 94' at the inner projections 93, and frontward advancing paths 96 between the inner and outer projections 93 and 93' to form an endless zigzag shape.

The cam followers 86 each has a semi-ring shape defining an opening 97 and is disposed on the outer surface of the smaller diameter shaft 89. The cam follower 86 is provided with inward extending cam pins 98 at its opposite ends. The cam pins 98 are passed through the guide cut portions 92 of the smaller diameter shaft 89 and inserted in the cam stopping groove 85 to be guided along the groove 85.

The compression coil springs 87 each is inserted on the smaller diameter shaft 89 in order to bias the cam follower 86 inward.

The torsional spring 88 is inserted in a central bore 99 formed at the outer surface of the cam supporting plate 84 and forcibly inserted on the end of the supporting pin 83. Also, the torsional spring 88 is fixed in a groove 100 at its outer end so that the torsional spring 88 functions to restrain or free the rotation of the supporting pin 83 in accordance with rotating direction of the duster assembly 20.

The operation of the nozzle head employing the means for stopping the duster supporting shaft according to the still another embodiment of the invention will be now explained.

When the nozzle head "A" is pushed frontward to clean the floor, the roller-shaped duster member 22 of the duster assembly 20 is rotated in a normal direction due to friction between the duster member 22 and the floor. The rotating force of the duster member 22 is transmitted to the duster supporting shaft 21 due to friction between the duster member 22 and the duster supporting shaft 21 so that the supporting pins 83 are also rotated by rotation of the duster supporting shaft 21. At the same time, the cam followers 86 mounted on the smaller diameter shafts 89 are rotated by rotation of the shaft 89. At this time, the cam supporting plates are maintained in the fixed condition by means of the pivot arms 46.

Since the cam pins 98 of the cam followers 86 are inserted in the axial guide cut portions 92 of the smaller diameter shafts 89, as the duster supporting shaft 21 is rotated in a normal direction, the cam pins 98 are guided by the inner projections 93 of the shaft parts 82 and moved outward against the compression coil springs 87 along the cam stopping grooves 85.

In this case, since the cam pins 98 of the cam followers 86 have been moved to the normal rotation stopping portions 94 of the cam stopping grooves 85, for example the portions (1), the cam pins 98 are caught on the outer projections 94 so that the duster assembly 20 can not be further rotated in the normal direction. Accordingly, the duster assembly 20 can wipe the floor in its stopped condition.

On the other hand, when the nozzle head "A" is pulled rearward, the cam pins 98 of the cam followers 86 are guided along the rearward advancing paths 95 and moved to the portions (2) until the cam pins 98 are caught on the inner projections 93. Thereafter, when the nozzle head "A" is again pushed frontward, the cam pins 98 are guided along the frontward advancing paths 96 and moved to the portions (3) so that the duster member 22 is rotated from the portions (1) to the portions (3) and stopped by the outer projections 93' at the portions (3). Hence, the duster member 22 can wipe the floor in its stopped condition. When the nozzle head "A" is again pulled rearward, the duster member 22 is rotated to the portions (4) in a reverse direction.

The movement of the cam pins 98, that is, the movement of the portions (1)→the portions (2) or the portions (3)→the portions (4) is carried out by the restoring force of the compression coil springs while the movement of the portions (2)→the portions (3) or the portions (4)→the portions (1) is carried out by outward slippage on slants of the inner projections 93'.

As described above, whenever the nozzle head "A" is pulled rearward and then pushed frontward, the duster member 22 is rotated at a predetermined angle so that the duster member 22 can wipe the floor with its fresh contacting surface.

In the present invention, it is preferable that the duster member 22 is rotated at an angle of 90° to clean the floor with its fresh contacting surface whenever the nozzle head "A" is pulled and pushed. In order to improve the cleaning efficiency of the duster member 22, the intervals between the inner projections 93 and the intervals between the outer projections 93' may be designed two times as narrow as those of the before instance so that the duster member 22 is rotated at an angle of 45° whenever the nozzle head "A" is pulled and pushed.

However, the rotating angle of the duster member 22 after one time of pulling and pushing movement of the nozzle head "A" is not limited to the angles of 90° and 45° and may be selectively changed in accordance with various factors, such as design requirement and cleaning circumstance.

In the pushing and pulling operation of the nozzle head, the force required to push the nozzle head is generally higher than that required to pull the nozzle head. Accordingly, since the torsional spring 88 is elastically wound around the supporting pin 83 when the nozzle is pushed frontward, the strong force exerting on the cam pins 98 of the cam follower 86 can be mitigated.

On the other hand, when the nozzle head is pulled rearward, the supporting pin 83 is rotated in the same direction as the restoring direction of the wound torsional spring 88 so that the supporting pin 83 is easily rotated and thus the force exerting on the cam pins 98 is also mitigated.

Figure 12:
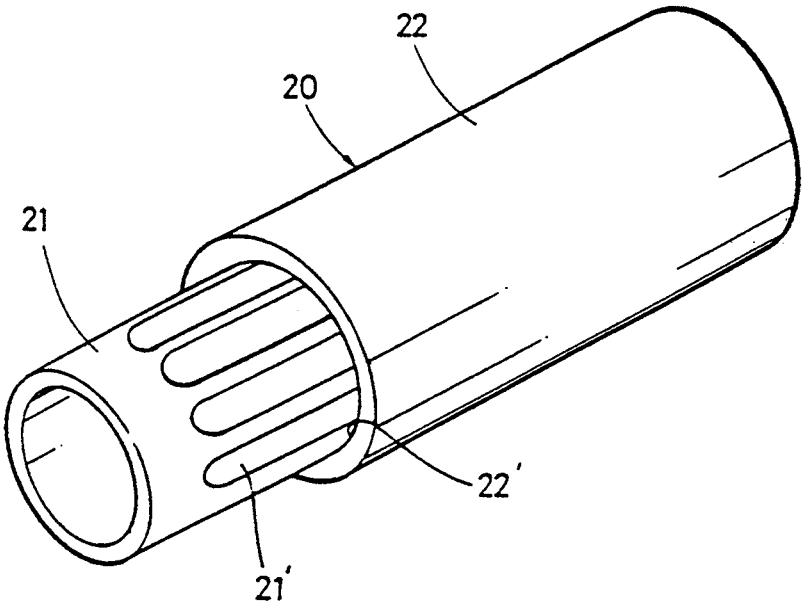
FIG. 12 is a perspective view of a duster supporting shaft according to another embodiment of the invention.
Figure 13A:
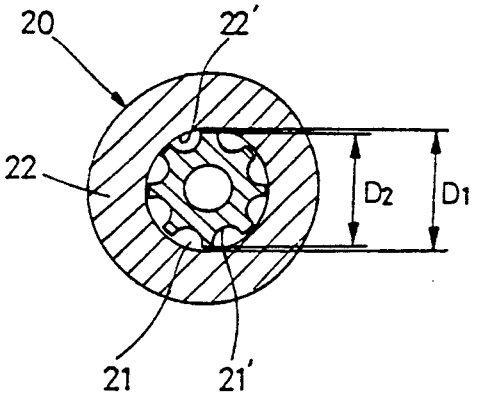
FIG. 13A is a sectional view of FIG. 12.
Figure 13B:
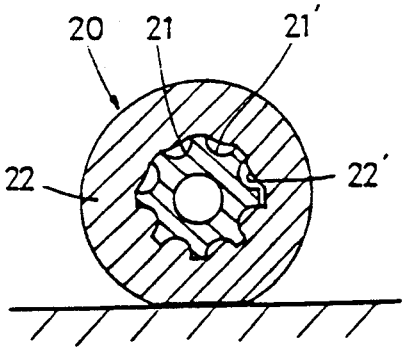
FIG. 13B is a view similar to FIG. 13A when a duster member is in contact with a floor.

Referring to FIGS. 12 to 13B, there are shown another embodiment of duster supporting shaft according to the invention. As shown in the drawings, the duster supporting shaft 21 has a circular shape in section. Also, the duster supporting shaft 21 is formed with a plurality of axial recesses 21' in order to increase frictional force between the duster supporting shaft 21 and the duster member 22.

In this case, it is preferable that the inner diameter "D1" of the duster member 22 is larger than the outer diameter "D2" of the duster supporting shaft 21 in order to facilitate fitting and drawing operation of the duster supporting shaft 21 into and from the duster member 22, as shown in FIG. 12A.

In use of the nozzle head employing the duster supporting shaft 21, the duster member 22 is compressed at its lower surface in contact with the floor so that the inner surface 22' of the duster member 22 is stuck into the axial recesses 21', thereby preventing slippage between the duster supporting shaft 21 and the duster member 22.

As described in detail hereinbefore, since the nozzle head for a vacuum cleaner according to the invention employs a roller-shaped duster member that is rotated through a predetermined rotational angle in accordance with the moving direction of the nozzle head, the cleaning surface of the duster member which is in contact with the floor is changed with a fresh cleaning surface when required so that it is possible to use large cleaning surface of the duster member, thereby improving cleaning efficiency of the duster member.

In addition, the nozzle head of the invention causes attachment and detachment of the duster member to be easy and separation of the duster member to be prevented during use, thereby providing the user with considerable convenience.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A nozzle head for a vacuum cleaner with a duster function comprising:

outer and inner casings which define front and rear air introducing paths therebetween;

a duster supporting shaft detachably and rotatably mounted in the inner casing;

a roller-shaped duster member for contacting a surface to be dusted inserted on the duster supporting shaft;

a duster holding member which has means for holding releasably the duster supporting shaft and is upward and downward slidably mounted in the inner casing;

means for releasably locking the duster holding member within the inner casing which is fixedly mounted on an inner surface of the inner casing; and means for stopping selectively rotation of the duster supporting shaft which is disposed between the duster holding member and opposite ends of the duster supporting shaft.

2. A nozzle head for a vacuum cleaner according to claim 1, wherein said means for holding the duster supporting shaft comprises:

two pairs of opposed side walls and recesses formed at lower ends of opposing side walls of the duster holding member which are adapted to receive the duster supporting shaft;

two pairs of pivot arms pivotally mounted on the lower ends of both side wall of the duster holding member which are adapted to hold the duster supporting shaft; and leaf springs fixed to both sides of the inner casing which are adapted to pivot the pivot arms when the duster holding member is raised and lowered.

3. A nozzle head for a vacuum cleaner according to claim 2, wherein each of said pivot arms is formed, at an outer surface of a lower end thereof, with an engaging groove, and each of said leaf springs is formed, at an inner surface of the lower end thereof, with a projection to be engaged with the engaging groove when the duster holding member is completely mounted in the inner casing.

4. A nozzle head for a vacuum cleaner according to claim 1, wherein said means for stopping the duster supporting shaft comprises:

a cam supporting plate releasably held in the duster holding member which is formed at inner surface thereof with a guide groove;

a supporting pin fixed to a center of an end of the duster supporting shaft via the cam supporting plate which permits the duster supporting shaft to be rotated relative to the cam supporting plate;

a cam follower inserted in the guide groove which is upward and downward movable; and a cam stopping groove formed at the end of the duster supporting shaft which receives an inner end of the cam follower and permits the duster supporting shaft to be rotated in one direction by the cam follower.

5. A nozzle head for a vacuum cleaner according to claim 4, wherein said cam follower comprises:

a head received in the guide groove of the cam supporting plate;

a protrusion provided at an inner surface of the head which is extended inward;

a compression spring inserted on the protrusion; and a cap slidably inserted on the protrusion and inserted in the cam stopping groove which is biased inward by the compression spring.

6. A nozzle head for a vacuum cleaner according to claim 4, wherein said cam stopping groove is formed at its bottom surface with serrated vertical surfaces for preventing normal rotation and inclined surfaces alternatingly,

7. A nozzle head for a vacuum cleaner according to claim 1, wherein said means for stopping the duster supporting shaft comprises:.

at least one of ratchet tooth formed at an outer surface of an end of the duster supporting shaft; and a pawl piece fixed to the duster holding member which is adapted to be engaged with the ratchet tooth to prevent the normal rotation of the duster supporting shaft.

8. A nozzle head for a vacuum cleaner according to claim 1, wherein said means for stopping the duster supporting shaft comprises:

a smaller diameter shaft provided at an end of the duster supporting shaft which has an outer diameter smaller than that of the duster supporting shaft and which smaller diameter shaft is formed at an outer end thereof with a circular recess and formed with at least one of axial guide cut portion;

a cam supporting plate which is provided at an inner surface thereof with a shaft part the shaft part being formed at an outer surface thereof with a serrated cam stopping groove, inserted in the circular recess of the duster supporting shaft and rotatably inserted on a supporting pin fixed to a center of an end of the duster supporting shaft and rotatably inserted on a supporting pin fixed to a center of an end of the duster supporting shaft;

a cam follower mounted on the smaller shaft a free end of which is inserted in the cam stopping groove through the axial guide cut portion; and a compression spring adapted to bias the cam follower inward;

whereby the cam follower is moved from a tooth position to the next tooth position of the serrated cam stopping groove whenever the duster supporting shaft is rotated in a reverse direction and rotated in a normal direction.

9. A nozzle head for a vacuum cleaner according to claim 8, wherein said means for stopping the duster supporting shaft further comprises a torsional spring inserted in a central bore formed at an outer surface of the cam supporting plate, which is tightly inserted on an outer end of the supporting pin and fixed to an outer end of the cam supporting plate, whereby the torsional spring provides the supporting pin with a restoring rotating force when the nozzle head is pulled rearward.

10. A nozzle head for a vacuum cleaner according to claim 8, wherein said cam stopping groove is defined by a plurality of inner and outer projections formed at the outer surface of the shaft part which are positioned alternatingly such that normal rotation stopping portions at the outer projections, rearward advancing paths between the inner and outer projections, reverse rotation stopping portions at the inner projections, and frontward advancing paths between the inner and outer projections are successively formed in the cam stopping groove.

11. A nozzle head for a vacuum cleaner according to claim 8, wherein said cam follower comprises a semi-ring member slidably mounted on the smaller diameter shaft and a cam pin fixed to an end of the semi-ring member and inserted in the cam stopping groove of the shaft part through the axial guide cut portion of the smaller diameter shaft.

12. A nozzle head for a vacuum cleaner according to claim 1, wherein said duster supporting shaft has a rectangular axial cross-section.

13. A nozzle head for a vacuum cleaner according to claim 1, wherein said duster supporting shaft has a circular section.

14. A nozzle head for a vacuum cleaner according to claim 13, wherein said duster supporting shaft is formed at an outer surface thereof with a plurality of axial recesses in order to increase frictional force between the duster member and the duster supporting shaft when the duster member is in contact with a floor.

* * * * *